US005295531A

United States Patent [19]

Tsunekawa et al.

[11] Patent Number: 5,295,531

[45] Date of Patent: Mar. 22, 1994

[54] AIR CONDITIONER WITH OUTSIDE AIR INTRODUCTION PATH

[75] Inventors: Shoji Tsunekawa, Nitta; Koji Mori; Yoshiki Ikari, both of Ashikaga; Fujio Suzuki, Ota; Toshiyuki Komuro, Oura; Toshimasa Tsukui, Sakai, all of Japan

[73] Assignee: Sanyo Electric Co., Ltd., Osaka, Japan

[21] Appl. No.: 939,685

[22] Filed: Sep. 2, 1992

[30] Foreign Application Priority Data

| | | | |
|---|---|---|---|
| Sep. 2, 1991 | [JP] | Japan | 3-221448 |
| Sep. 13, 1991 | [JP] | Japan | 2-235171 |
| Sep. 13, 1991 | [JP] | Japan | 3-235172 |

[51] Int. Cl.[5] ..... F25B 29/00

[52] U.S. Cl. ..... 165/48.1; 165/59; 165/64; 62/262; 62/411; 62/410; 392/372; 219/510; 219/517

[58] Field of Search ..... 62/262, 263, 410, 411, 62/412, 325; 165/48.1, 59, 64; 392/372; 219/510, 517

[56] References Cited

U.S. PATENT DOCUMENTS

| | | | |
|---|---|---|---|
| 2,332,730 | 10/1943 | Kucher | 62/262 |
| 3,022,647 | 2/1962 | Mullin | 62/262 |
| 3,659,432 | 5/1972 | Selhost | 62/262 |
| 3,792,593 | 2/1974 | Loos et al. | 62/262 |
| 4,129,996 | 12/1978 | Hardin et al. | 62/262 |
| 4,478,053 | 10/1984 | Yano et al. | 62/262 |
| 4,524,588 | 6/1985 | Bond | 62/262 |
| 4,553,405 | 11/1985 | Napolitano et al. | 62/262 |

FOREIGN PATENT DOCUMENTS

| | | | |
|---|---|---|---|
| 0134129 | 7/1985 | Japan | 62/262 |
| 62-38175 | 9/1987 | Japan . | |
| 63-181723 | 11/1988 | Japan . | |

*Primary Examiner*—John K. Ford

*Attorney, Agent, or Firm*—Wenderoth, Lind & Ponack

[57] ABSTRACT

An air conditioner having a partition for partitioning the inside thereof into indoor and outdoor sections with an intake port. A damper is provided at the intake port so that an outdoor air introduction path of the outdoor section and an outdoor air discharge path are cut off when introducing outdoor air by opening the damper. Air the outdoor air introduction path is guided into the indoor section.

6 Claims, 8 Drawing Sheets

AIR CONDITIONER WITH OUTSIDE AIR INTRODUCTION PATH

BACKGROUND OF THE INVENTION

The present invention relates to an air conditioner so mounted as to penetrate through an indoor wall. More particularly, the present invention relates to a packaged terminal air conditioner having a structure for drawing outdoor air into a room.

An air conditioner for drawing outdoor air into a room is shown in, for example, U. S. Pat. No. 4,553,405, Japanese Utility Model Publication No. 62-38175/1987 and Japanese Utility Model Publication (unexamined) No. 63-181723/1988.

In the air conditioner disclosed in U. S. Pat. No. 4,553,405, the inside of a casing is divided by a partition into an indoor section and an outdoor section, and outdoor air is drawn by the revolution of a propeller fan via a left portion (or right portion) of the back or the outdoor section, is guided into a fan case, is cooled or heated by an outdoor heat exchager, and is then discharged via the rear center of the outdoor section. Indoor air is drawn via a lower part of the indoor section by the revolution of an indoor blower (centrifugal fan) of the indoor section, is cooled or heated by an indoor heat exchanger and is then discharged into the room via an upper center portion of the indoor section. However, as an outdoor air introduction mechanism from the outdoor section to the indoor section, an exclusive ventillation assembly is interposed between the partition for separating the inside section from the indoor section and the fan case inside the outdoor section.

According to the ventillation method (the method of introducing outdoor air into the room) disclosed in U.S. Pat. No. 4,553,405, a hole is bored in each of the fan case (condenser fan shroud) and the partition, the ventillation assembly is so fitted as to communicate these holes with each other, a damper (door) is disposed inside a ventillation path of the ventillation assembly, and this damper is inevitably smaller than the ventillation assembly. Since external air inside the fan case is guided into the indoor section through the ventillation assembly by means of the revolution of the indoor blower, the flow of outdoor air drawn into the indoor section extends along the ventillation path inside the ventillation assembly and does not become a smooth flow (in other words, the air stream resistance is large), so that the quantity of ventillation is not always sufficient. A cable or an actuator for rotating this damper (door) is merely stretches exposed inside the outdoor section through which the outdoor air passes, and is guided outside the apparatus. Therefore, it is likely to rust and to be broken in the course of use for a long time.

In the air conditioner described in Japanese Utility Model Publication No. 62-38175/1987, an indoor blower is so disposed as to oppose an indoor heat exchanger functioning as an evaporator, a drain pan is disposed below this heat exchanger, and a flat sheet-like suction plate (bell mouth plate) is provided between the drain pan and the fan casing of the indoor blower. However, when the mere flat sheet-like suction plate is used, a dimensional assembly error is likely to occur unless the individual dimensional accuracy of the drain pan, the fan casing and the suction plate is improved.

In the air conditioner disclosed in Japanese Utility Model Publication (unexamined) No. 63-171723/1988, a heater is disclosed at the back of an indoor heat exchanger, and a shield plate is disposed above this heater so as to detect the radiant heat rising from the heater by a temperature detector fitted to this shield plate. However, the shield plate and the heater fitting device to which the temperature detector is fitted are in turn fitted to separate elements, respectively, and consequently fitting errors are likely to occur. Accordingly, it is difficult to accurately detect abnormal heating of the heater.

SUMMARY OF THE INVENTION

In view of the problems encountered in the prior art described above, it is a primary object of the present invention to provide an improved air conditioner.

Another object of the present invention is to provide a new air conditioner for solving the problems in the conventional air conditioners described above by providing a partition for partitioning the inside thereof into an indoor section and an outdoor section with an intake port, and disposing a damper at this intake port. An outdoor air introduction path of the outdoor section and an outdoor air discharge path are thus cut off at the time of introduction of outdoor air by opening the damper, and air inside this outdoor air introduction path is guided into the indoor section.

A further object of the present invention is to provide an improved air conditioner in which a lower portion of a suction plate (bell mouth plate) of an indoor blower is resiliently fitted between a drain pan below a heat exchanger and a fan casing of an indoor blower so as to prevent the occurrence of a dimensional assembly errors of each element.

Another object of the present invention is to provide an improved air conditioner in which a shield for partly cutting off the flow of heated air heated by a heater is provided. A fuse and a temperature detector are directly fitted to the upper part of this shield plate, and can thus prevent the occurrence of dimensional error between the shield plate and a fuse fitting member, and hence can reliably detect abnormal heating of the heater with the fuse and the temperature detector.

In an air conditioner of the type wherein the inside of a housing is partitioned by a partition into an indoor section and an outdoor section. An indoor heat exchanger and a centrifugal fan operating as an indoor blower are disposed in the indoor section. An outdoor heat exchanger disposed at the center of the back of the outdoor section, an outdoor blower so disposed as to oppose the outdoor heat exchanger and a fan case for guiding outdoor air drawn via right and left suction ports on the back of the outdoor section by the revolution of the outdoor blower into the outdoor heat exchanger are accommodated in the outdoor section.

The air conditioner according to the present invention has a structure wherein an intake port for guiding outdoor air drawn from one of the right and left suction ports of the outdoor section into the indoor section is disposed on the partition. A damper is disposed at this intake port, and this damper is opened at the time of introduction of outdoor air so as to cut off an outdoor air introduction path extending from one of the suction ports to the intake port, and an outdoor air discharge path extending from this outdoor air introduction path to the outdoor heat exchanger are cut off from each other.

As described above, the intake port is disposed in the partition for partitioning the inside into the indoor section, and the outdoor section and the damper for separating the outdoor air introduction path from the outdoor air discharge path at the time of opening of the damper is disposed at this intake port. Accordingly, when outdoor air is introduced, this damper is rotated around a support pivot by the operation of a wire facing the side surface of the housing and is opened so that the tip of the damper strikes the fan case. In this way, the outdoor air introduction path and the outdoor air discharge path are cut off from each other in the outdoor section, and one of the suction ports on the outdoor side is linearly connected to the indoor section through one intake port. Consequently, outdoor air is smoothly introduced into the indoor section from this suction port by the operation of the indoor blower. The outdoor air is mixed with the indoor air and is discharged into the room through a supply grill. In other words, since the outdoor air flowing into the outdoor section is guided into the indoor section through the intake port, convection does not occur towards the outdoor blower side, and the outdoor air completely flows into the indoor side.

In a preferred embodiment of the present invention, a resilient plate to be resiliently fitted between the drain pan and the casing is disposed at the lower part of the bell mouth plate described above. When the bell mouth plate is disposed on the front surface of the fan casing of the centrifugal fan (indoor blower) in this way, the resilient plate of this bell mouth plate is fitted between the fan casing and the drain pan. Accordingly, correct positioning of the drain pan, the fan casing and the bell plate can be accomplished during assembly by utilizing the resiliency of this resilient plate by merely pushing the bell mouth plate into the gap described above.

In another preferred embodiment of the present invention, a shield plate is disposed at part of the downstream side of an electric heater for heating, and a fuse of the electric heater and/or a temperature detector is fitted to an upper part of this shield plate. According to this structure, when the blower (fan) is rotated, guided air flows into the electric heater from the suction grill on the front side through the heat exchanger, is heated by the electric heater and converted to heat air, and is discharged from the intake port to a discharge port at an upper part through the blower. In this case, since the shield plate having the fuse and/or the temperature detector fitted thereto is positioned at part of the downstream side of the electric heater, part of the heated air is not immediately sucked by the blower, but strikes the shield plate, rises and reaches the fuse and the temperature detector. Accordingly, reliable temperature detection can be made reliably.

BRIEF DESCRIPTION OF THE DRAWINGS

FIG. 3 is an exploded perspective view of principal elements of the packaged terminal air conditioner shown in FIG. 1, FIGS. 4 to 6 are perspective view of a damper of the packaged terminal air conditioner shown in FIG. 1 and its peripheral elements, wherein:

DETAILED DESCRIPTION OF THE PREFERRED EMBODIMENTS

Hereinafter, preferred embodiments of the present invention will be explained with reference to the accompanying drawings.

Figure 1:
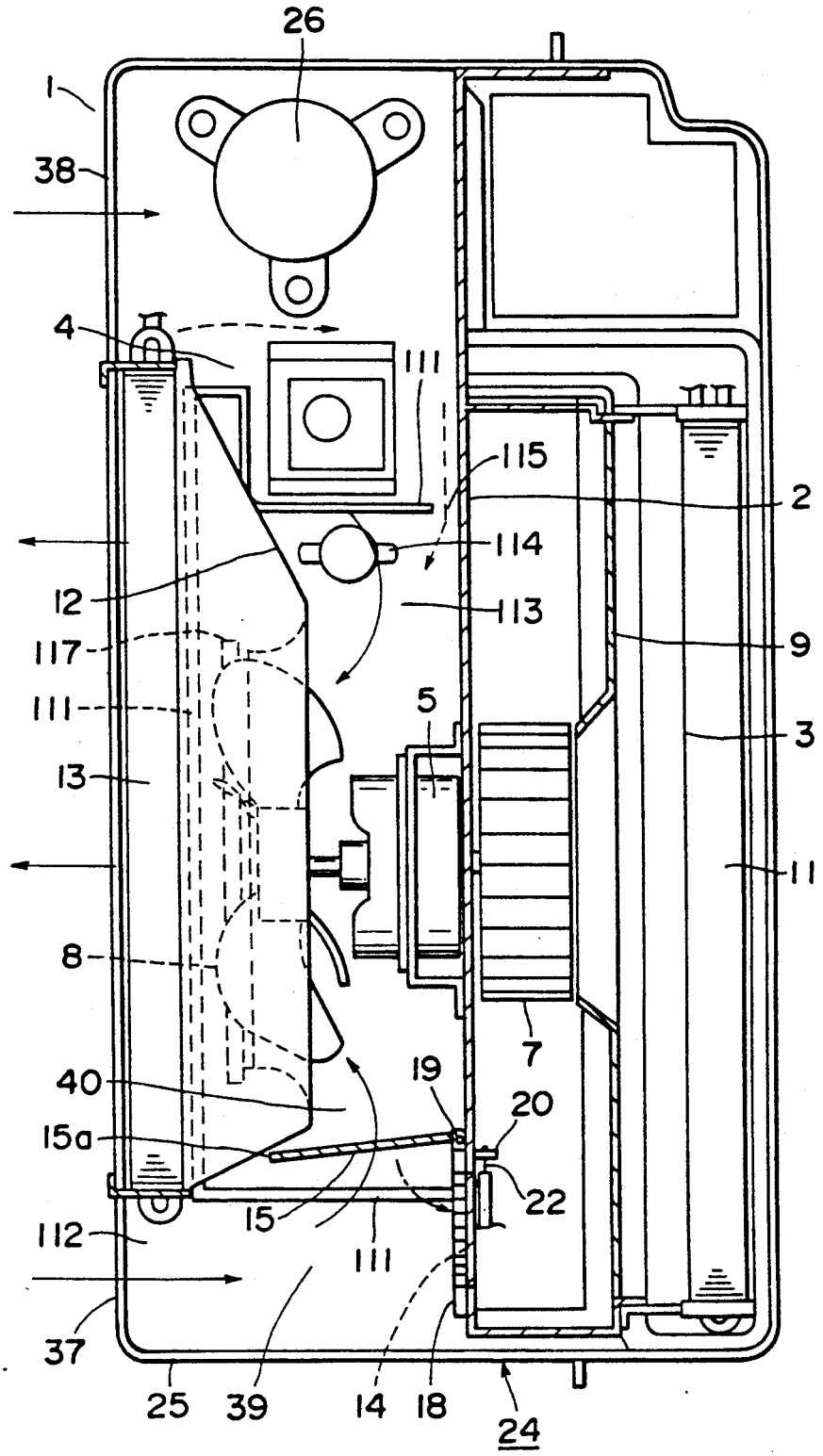
FIG. 1 is a transverse sectional view of a packaged terminal air conditioner according to a preferred embodiment of the present invention.
Figure 2:
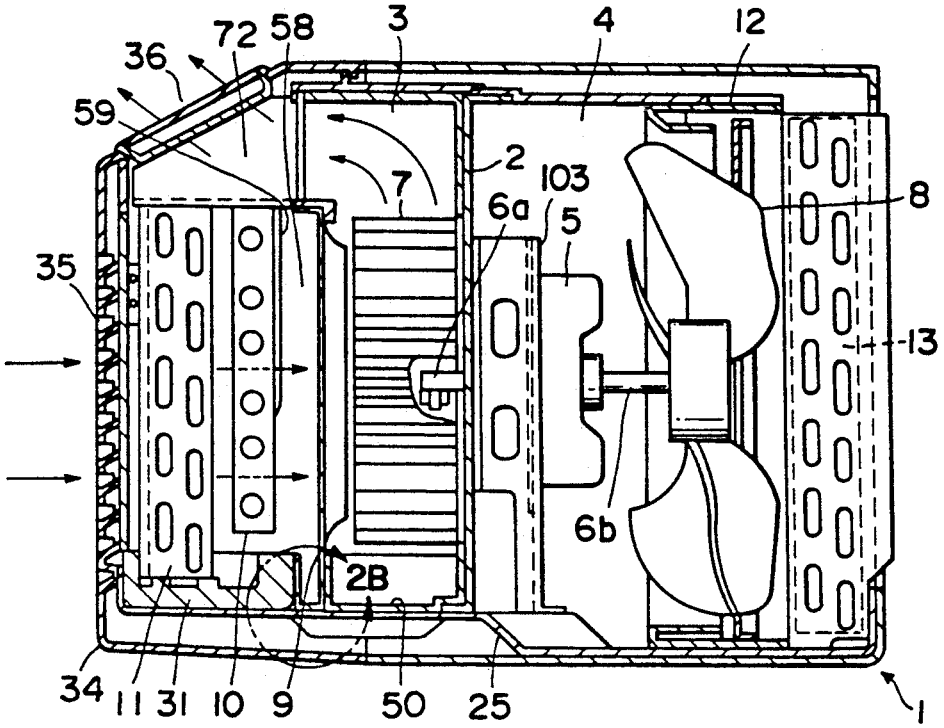
FIG. 2 is a longitudinal sectional view of the packaged terminal air conditioner shown in FIG. 1.
Figure 3:
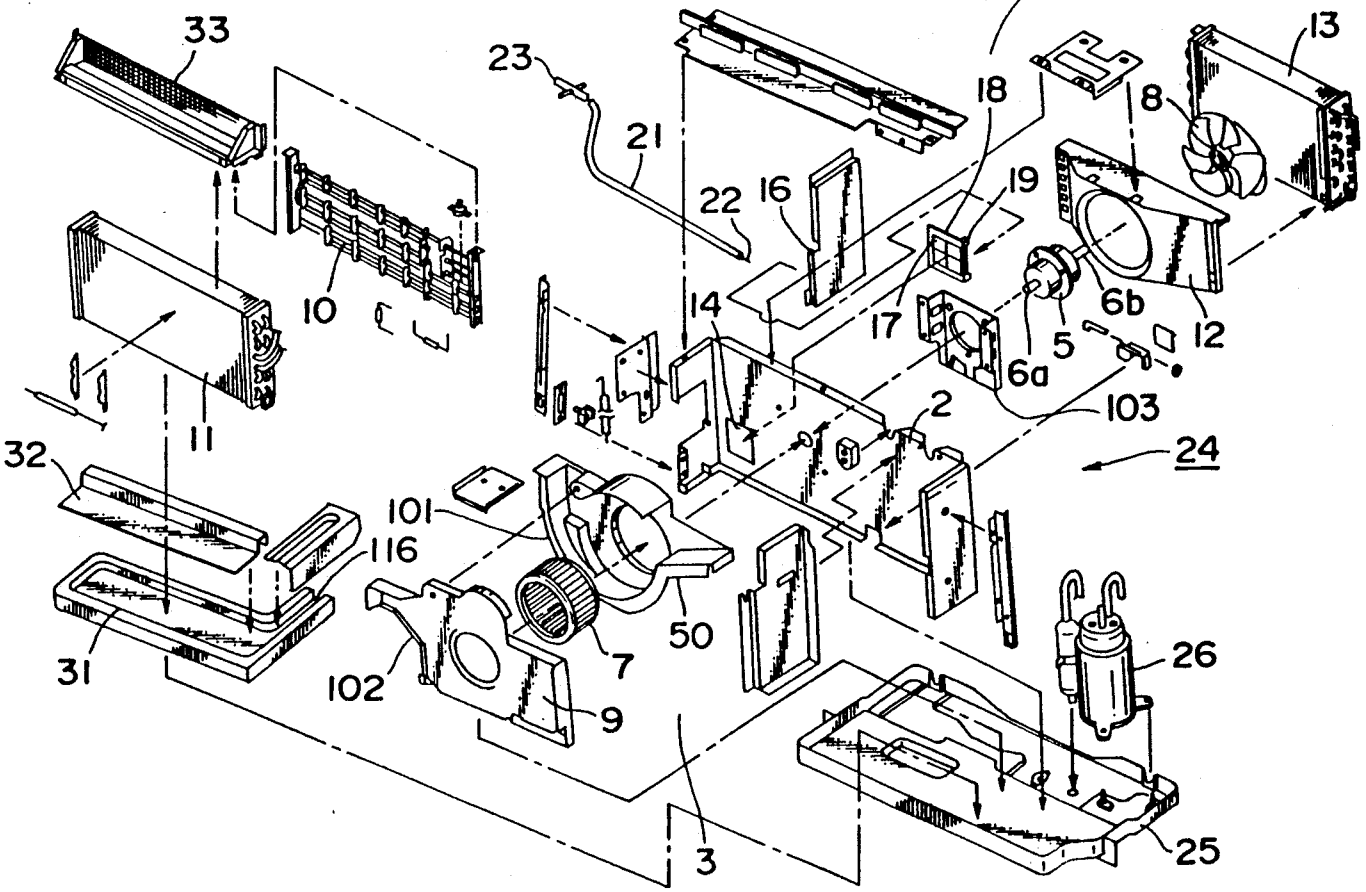
Figure 4:
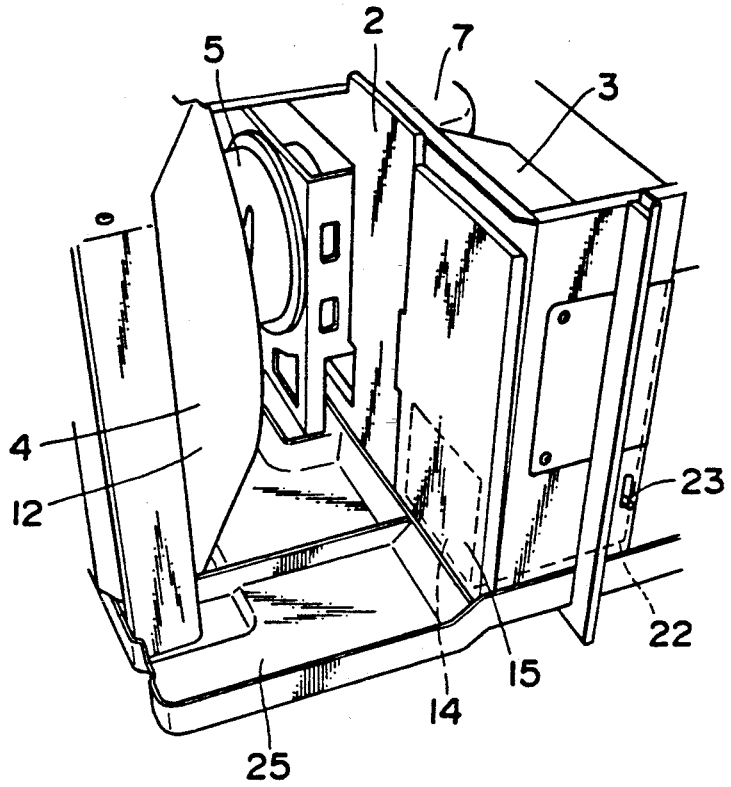
FIG. 4 shows a closed state of the damper.
Figure 5:
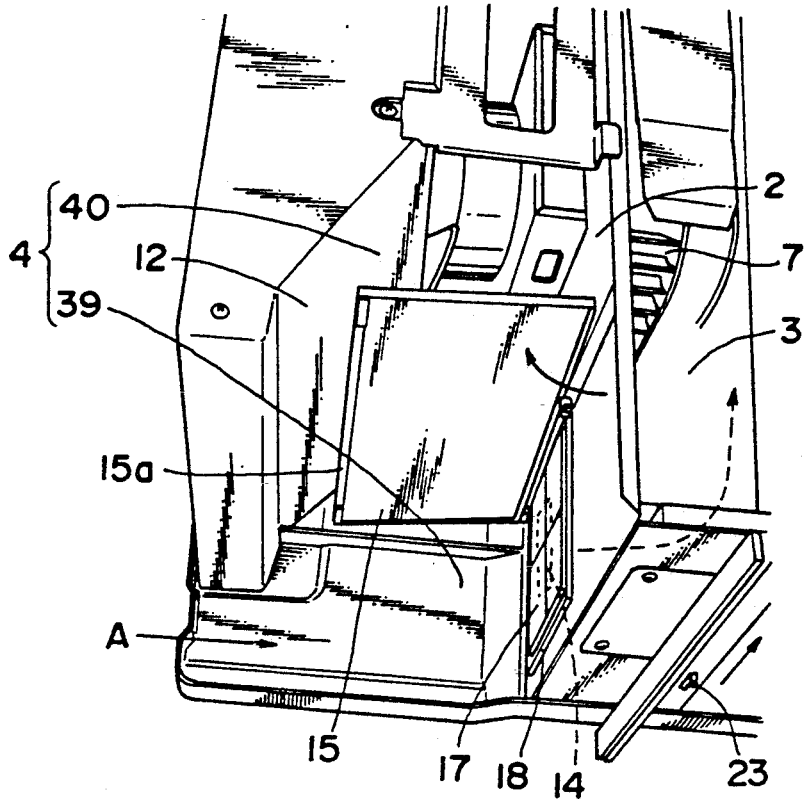
FIG. 5 shows an open state of the damper.
Figure 6:
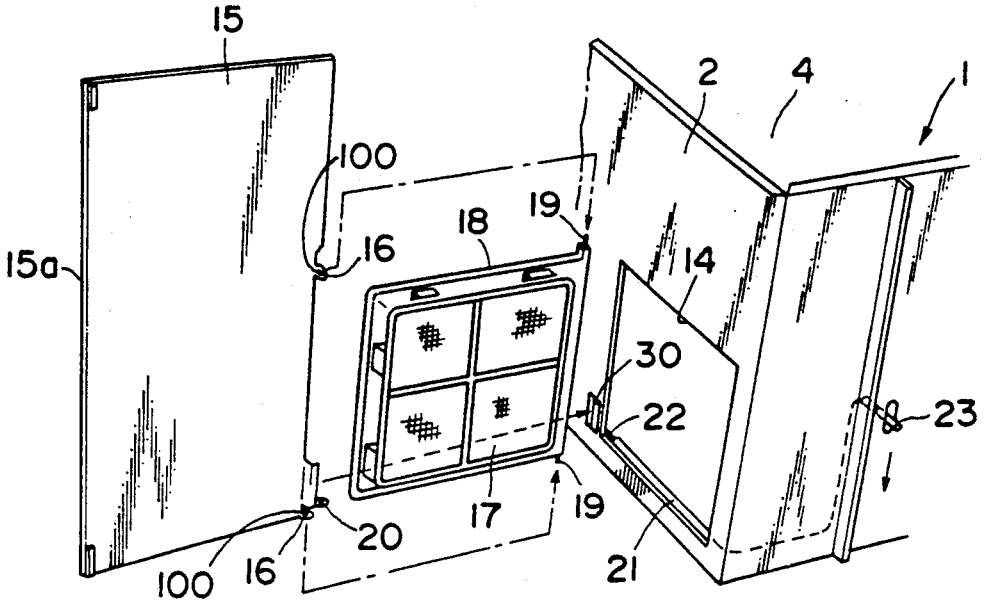
FIG. 6 shows an assembly state of the damper.

Referring first to FIGS. 1 to 3 showing a packaged terminal air conditioner which is mounted to penetrate through an indoor wall, in which reference numeral 1 denotes a case (housing), a bottom plate 25 is inserted into this case 1 and a partition 2 implanted to the bottom plate 25 partitions the inside of the case 1 into an indoor section 3 and an outdoor section 4. A drive motor 5 is fitted to the center of this partition 2 on the outdoor section 4 side, and a centrifugal fan 7 facing the indoor section 3 and a propeller fan 8 facing the outdoor section 4 are fitted to rotary shafts 6*a* and 6*b* that protrude from the front and back of the motor 5, respectively. The centrifugal fan 7 operates as an indoor blower while the propeller fan 8 operates as an outdoor blower. A bell mouth plate 9 is disposed on the front surface of the centrifugal fan 7. A heater 10 and an indoor heat exchanger 11 are disposed in front of the bell mouth plate 9. An outdoor heat exchanger 13 is disposed at the back of the propeller fan 8, and an outdoor fan case 12 is connected to the end portion of this heat exchanger. An intake port 14 for introducing outdoor air is bored on the right or left side of the partition 2. A large damper 15 having substantially the same height as that of the partition 2 is fitted in a cantilever arrangement to one of the surface of the intake port 14 which is positioned on the side of the outdoor section 4 as shown in FIG. 6. In other words, a support plate 16 having a hole 100 exists at the base end of the damper 15, and a synthetic resin intake frame 18 having an insect screen 17 attached thereto is fitted to the intake port 14. The hole 100 of the support plate 16 is meshed with a support shaft portion 19 which is formed integrally with this intake frame 18 (FIG. 6). A tip portion 15*a* of the damper 15 is so arranged as to come into contact with the surface of the outdoor fan case 12 (FIG. 5). This damper 15 is equipped at its lower end with an operation plate portion 20, which protrudes towards the outdoor section 4 through a hole 30 adjacent to the intake port 14.

Figure 7:
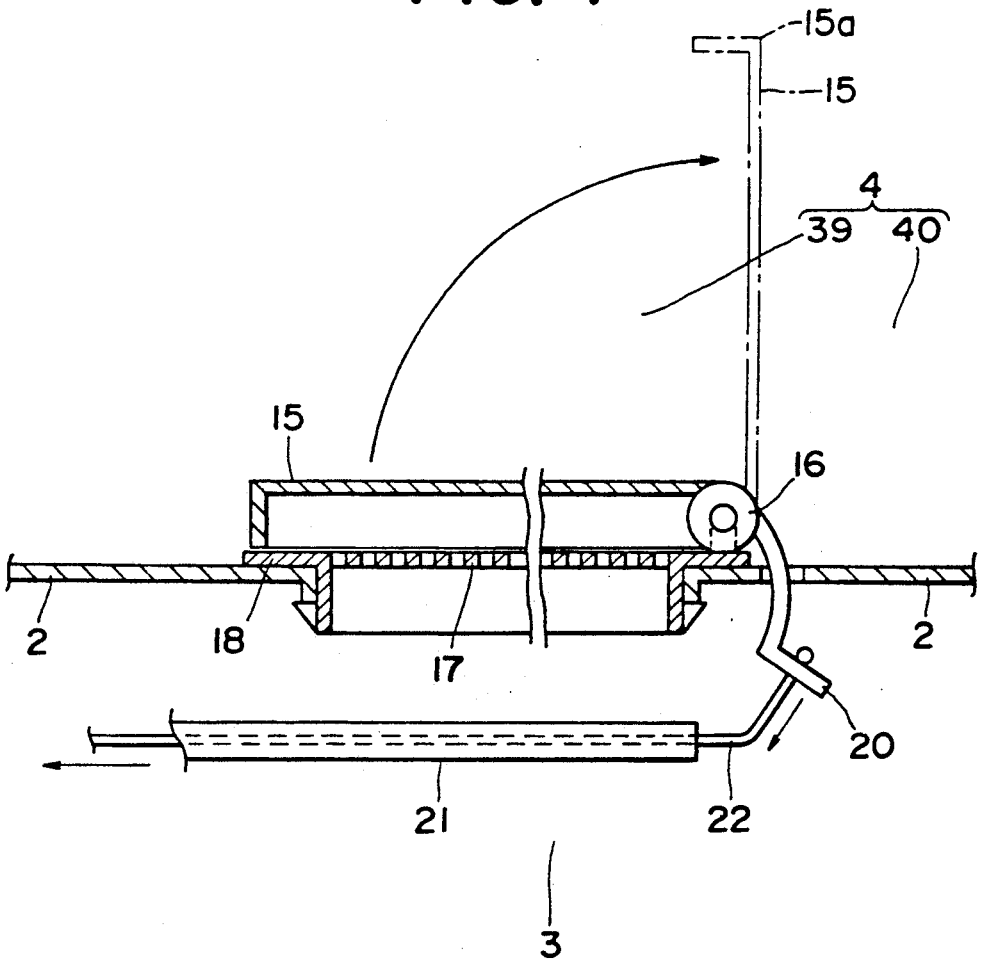
FIG. 7 is a sectional view of the damper shown in FIG. 4.
Figure 8:
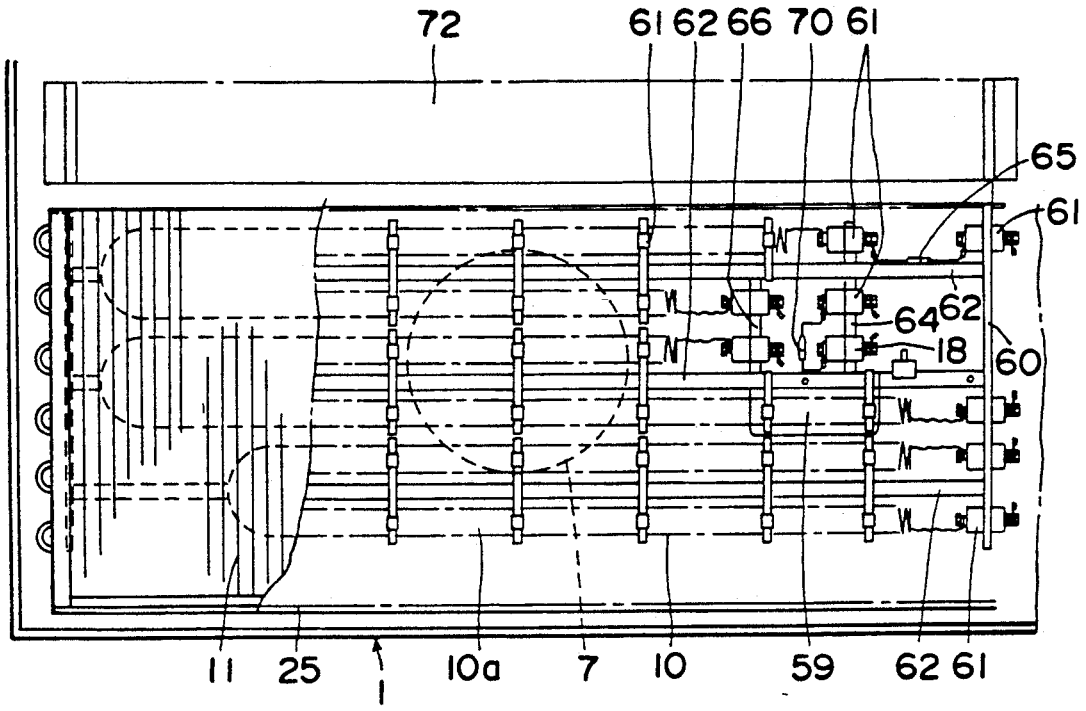
FIG. 8 is a front view showing the principal portions of an electric heater built in the packaged terminal air conditioner shown in FIG. 2.

The operation plate portion 20 protruding towards the outdoor section 4 is interconnected with an operation wire 22, which is inserted through a resin tube 21 (FIG. 7). As shown in FIG. 6, this resin tube 21 is extended along the lower portion of the synthetic resin intake frame 18 and its tip is interconnected to a switch lever 23 disposed at the side portion of the main body. When this switch lever 23 is moved up and down manually, the damper 15 can be opened and closed, which will be described presently.

In FIG. 3, a compressor 26, a drain pan 31 made of a foamed styrol and a heat insulating plate 32 placed on the drain pan 31 are shown. The heat insulating plate 32 cuts off the radiation heat from the indoor heat exchanger 11 and the electric heater 10 and protects the drain pan 31. Reference numeral 33 denotes a blast member. The electric heater 10 is fixed below the blast member 33, and the blast member itself is placed on the indoor, heat exchanger 11.

A known heat pump system refrigeration cycle is constituted by connecting the compressor 26, a cold/-hot flow path switch valve (not shown), the indoor heat exchanger 11, an expansion valve (not shown) and the outdoor heat exchanger 13 by with piping so as to cool or heat the room.

In this case, the propeller fan 8 of the outdoor section 4 is driven for rotation by the motor 5 to suck the outdoor air from the right and left suction port 37 and 38 on the back of the outdoor chamber 4, and after this air is cooled or heated by the outdoor heat exchanger 13, it is discharged from the center of the back of the outdoor heat exchanger, as shown by an arrow of a solid line in FIG. 1. In the indoor section 3, on the other hand, the indoor air is sucked from the suction port 35 of the front surface of the indoor section 3, that is, the front cover 34, and after being cooled or heated by the indoor heat exchanger 11, it is blown out from the discharge port 36 of the front cover 34, as shown by the arrow of the solid line in FIG. 2. At this time, the damper 15 is not opened but keeps its contact with the insect screen 17 serving as the intake port 14 of the partition 2, and the indoor section 3 and the outdoor section 4 are cut off from each other. Moreover, in this outdoor section 4, an outdoor air introduction path 39 extending from one of the suction ports 37 to the intake port 14 is kept connected to an outdoor air discharge path 40 extending from this outdoor air introduction path 39 to the outdoor heat exchanger 13 (FIG. 1).

Figure 2B:
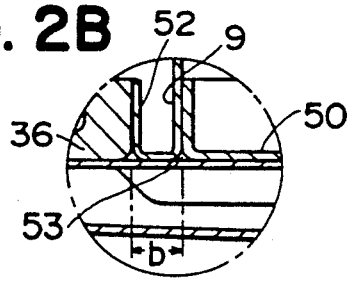
FIG. 2B is an enlarged detail view from FIG. 2.
Figure 2A:
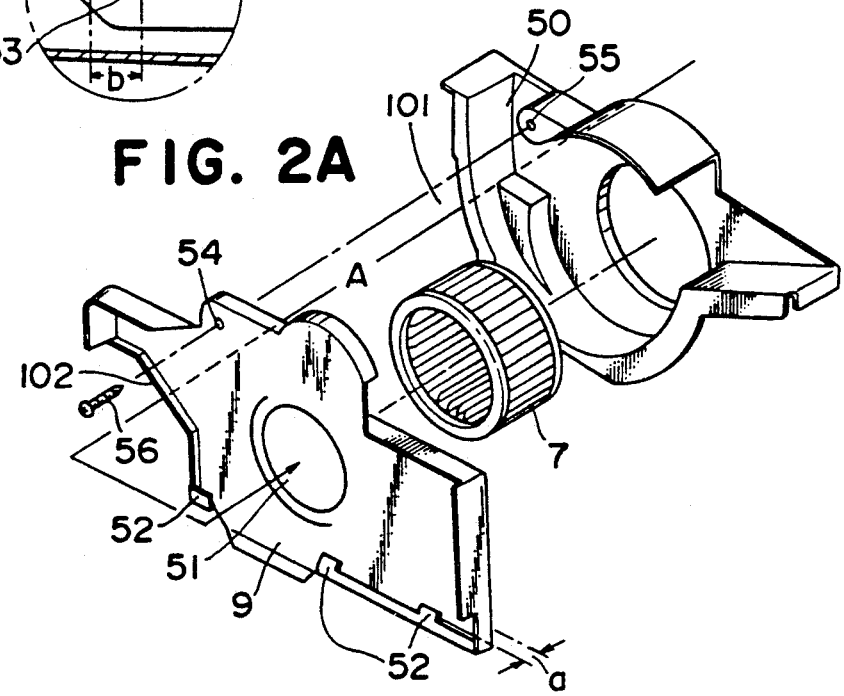
FIG. 2A is an exploded perspective view of a bell mouth plate, a centrifugal fan and a fan casing used for the packaged terminal air conditioner shown in FIG. 2.

To introduce the external air into the indoor side at this time, the switch lever 23 disposed at the side portion of the main body or the case 1 is moved up as shown by the arrow of the solid line in FIGS. 5 and 7. Then, the wire 22 connected to this switch lever 23 pulls the resin tube 21 and the operation plate portion 20 at the end of the damper 15. Consequently, the damper 15 rotates with the support shaft 19 of the intake frame 18 as a pivot, its tip 15*a* strikes the wall surface of the fan case 12, the outdoor air introduction path 39 and the outdoor air discharge path described above cut off the flow of the outdoor air flowing from outside the room into the outdoor section 4, and the indoor section 3 and the outdoor section 4 are connected to each other through the insect screen 17 (FIG. 7). Due to the rotation of the centrifugal fan 7, the outdoor air A flows into the indoor section 3 through the intake port 14 of the partition 2. This inflow outdoor air A is guided to the portion in front of the bell mouth plate 9 through the left side portion 101 of the fan casing 50 and through the notch 102 of the bell mouth portion 9 (FIG. 2A). The outdoor air A is then sucked into the suction port 51 of the bell mouth 9 with the indoor air of the indoor section 3 that flows due to the rotation of the centrifugal fan 7, is then cooled or heated by the indoor heat exchanger 11, and is thereafter discharged into the room via the discharge port 36.

In this way, the flow of the outdoor air A flowing into the outdoor section 4 via one of the suction ports 37 to the outdoor heat exchanger 13 is cut off by the damper 15, as represented by the solid line arrow shown in FIG. 5. Accordingly, the outdoor air A is not affected by the suction operation of the outdoor blower 8 but flows directly into the indoor section 3 through the intake port 14. When the number of revolution of the outdoor blower (propeller fan) 8 is equal to that of the indoor blower (centrifugal fan) 7 and the intake port 14 is merely opened, the static pressure generated by the operation of the outdoor blower 8 is lower than the static pressure generated by the operation of the indoor blower 7. Accordingly, the outdoor air cannot be introduced into the indoor air. In the packaged terminal air conditioner 24 of the present invention, however, the tip portion 15*a* of the damper 15 strikes the outdoor fan case 12 when the damper 15 is opened, and the outdoor air introduction path 39 of the outdoor section 4 and the outdoor air discharge path 40 are cut off substantially completely, as shown in FIG. 1. Accordingly, even when the indoor and outdoor blowers 7 and 8 are operated, the static pressure of the outdoor air introduction path 39 communicating with the intake port 14 is kept lower than the static pressure of the indoor section, so that the outdoor air is guided into the indoor section 3 by the operation of the indoor blower 7 through the outdoor air introduction path 39 and the intake port 14.

The wire 22 for rotating the damper 15 runs at the lower part of the indoor section 3 and is covered with the resin tube 21. Therefore, it does not generate adhesion of air or water droplets, etc., staying at the bottom, and does not generate rust in the course of its use for a long time.

As described above, in the packaged terminal air conditioner 24 according to the present invention, the intake port is merely disposed in the partition for partitioning the outdoor section from the indoor section, the damper is disposed so as to open and close the intake port, and the outdoor air introduction path of the outdoor section and the outdoor air discharge path are cut off from each other by the damper. Consequently, when the outdoor air is introduced into the room, the air can flow smoothly, with smaller air stream resistance, by the rotation of the damper alone, and sufficient introduction of the outdoor air and a sufficient quantity of ventillation quantity can be obtained.

In FIG. 1, a water guide plate 111 is implanted onto the bottom plate of the outdoor section 4, and space on the bottom plate of the outdoor section 4 is divided by the water guide plate 111 into a primary side drain receiver 112 and a secondary side drain receiver 113. The outdoor heat exchanger 13 and the compressor 26 are positioned on the primary side drain receiver 112, and the outdoor blower 8 and the drain valve 114 are positioned on the second drain receiver 113. The drain valve 114 is disposed at the drain port (not shown) of the bottom plate 25, and a heat-sensitive cylinder (not shown) is disposed in this drain valve 114. The heat-sensitive cylinder senses the temperature of the outdoor section 4 (the outdoor air temperature) and controls the operation of the drain valve 114. In other words, when the temperature of the outdoor section is below 15° C., the air conditioner is generally in the heating operation. Accordingly, the drain valve 114 is moved up to open the drain port. Drain water purified by the outdoor heat exchanger 13 during the heating operation is stored in the primary side drain receiver 112, and drain water thus stored flows into the secondary side drain receiver 113 from the gap 115 between the water guide plate 111 and the partition 2. In this case, since drain water flows through the gap 115, represented by the dashed arrow, the heat of the indoor section 3 is transmitted to the drain water through the partition 2, so that freezing of the drain water can be prevented in advance and drain water is quickly discharged from the drain port. On the other hand, when the temperature of the outdoor section 4 is higher than 15° C., the air conditioner is generally in the cooling operation. Therefore, the drain valve 114 is moved down to close the drain port. Accordingly, drain water generated by the indoor heat exchanger 11 during the cooling operation is stored in the secondary side drain receiver 113, via the drain pan 31, is slung up by a slinger ring 117 disposed in the outdoor blower 8 and is scattered to the outdoor heat exchanger 13.

A preferred example of the bell mouth plate 9 described above will be explained presently.

In FIGS. 2 and 2A, an intake port 51 facing the fan is disposed at the center of the bell mouth plate 9 as shown in FIG. 2A, and several, three in the drawing, upwardly U-shaped resilient plates 52 for locating a bending position are disposed at the lower edge. The lower portion of the bell mouth plate 9 having these resilient plates 52 is inserted into the gap 53 (FIG. 2B) defined between the lower end of the indoor side fan casing 50 and the drain pan 31. The indoor heat exchanger 11 and the electric heater 10 are disposed above the drain pan 31. After the screw hole 54 disposed at the upper part of the bell mouth plate 9 and the screw hole 55 disposed at the upper part of the indoor fan casing 50 are brought into conformity with each other, a screw 56 is fastened to set the indoor fan casing 50 and the bell mouth plate 9 with each other. At this time, since the turnback width a (FIG. 2A) of the resilient plates 52 is set to be somewhat greater than the gap width b (FIG. 2) of the gap 53, the resilient plates 52 fits into this gap 53 due to its resiliency when inserted.

The function and operation of the bell mouth plate 9 will be explained. First of all, when each component or constituent element of the packaged terminal air conditioner 24 of the present invention is assembled, the assembly work must be carried out efficiently and in accordance with stipulated dimensions. For example, after the partition 2 is implanted in the bottom plate 25, the motor table 103 having the motor 5 fitted thereto is placed from the outdoor section 4, and the rotation shaft 6a of the motor 5 is allowed to protrude the indoor section 3. In the indoor section 3, on the other hand, the indoor fan casing 50 is fixed to the side surface of the indoor section 3 of the patition 2 in such a manner that the rotary shaft 6a becomes the center thereof, and then the indoor blower is fixed to the rotary shaft 6a. Thereafter, the drain pan 31, is placed on the bottom plate 25, the heat insulating plate 32 is spread on the drain pan 31 and furthermore, the indoor heat exchanger 11 and the blast member 33 having the heater 10 fitted thereto are disposed on the heat insulating plate 32. The bell mouth plate 9 is then fitted to the intake path 58 of the fan casing 50.

In other words, when the bell mouth plate 9 is assembled and set, the bell mouth plate 9 is merely dropped into the intake path 58 defined between the indoor fan casing 50 and the electric heater 10 from the side of the resilient plates 52 at its lower end, and in this way the resilient plate 52 face the gap 53 between the indoor fan casing 50 and the drain pan 31 formed in advance. When the bell mouth plate 9 is further pushed down at this time, the resilient plates 52 at its tip (lower end) fit tightly and resiliently in to the gap 53, and the, lower portion of the bell mouth plate 9 can be positioned easily.

Thereafter, the screw 56 is fitted into the screw hole 54 bored at a part of the upper end of the bell mouth plate 9, and its tip is meshed with the screw hole 55 of the indoor fan casing 50 opposing the same, whereby the bell mouth plate 9 is fixed. In other words, the final fixing work can be made easily by inserting and fixing only one screw. The lower portion is spring-locked by the use of the resilient plate 52, and no screw is used.

To operate the packaged terminal air conditioner 24 having the construction described above, the motor 5 and the compressor 26 (FIG. 1) are driven by a predetermined device in the same way as in the prior art, and the refrigerant is caused to flow from the compressor to the cooling/heating flow paths with a valve (not shown), the indoor heat exchanger 11, an expansion valve (not shown) and the outdoor heat exchanger 13 so as to cool or heat the room.

As described above, the packaged terminal air conditioner 24 according to the present invention has a structure in which the resilient plate to be fitted into the gap between the drain pan and the fan casing is disposed at the lower end of the bell mouth plate to be assembled on the front surface of the fan casing. Therefore, when the bell mouth plate is merely pushed into the gap during assembly, positioning of the lower portion and clamping by resiliency can be accomplished. Accordingly, the dimensional accuracy of the drain pan, fan casing and suction plate (bell mouth plate) can be improved, and any assembly error can be reduced.

Another embodiment of the present invention will be described with reference to FIG. 2 and FIGS. 8 to 11.

Figure 9:
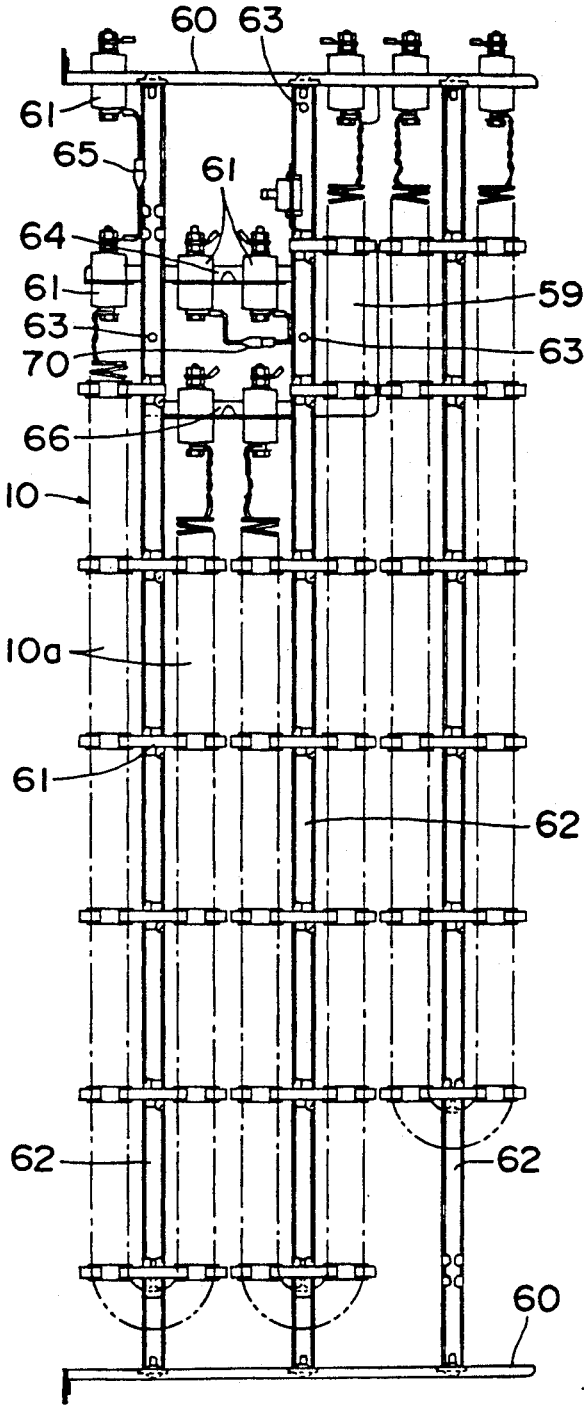
FIG. 9 is a front view of the electric heater shown in FIG. 8.
Figure 11:
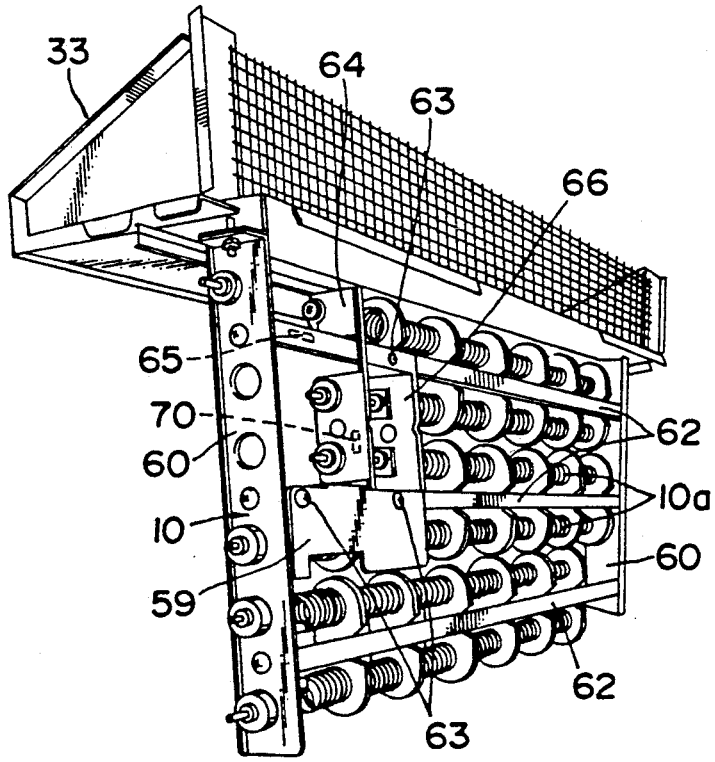
FIG. 11 is a perspective view of the electric heater shown in FIG. 9.

The end portion of a heater element 10a of the electric heater 10 is anchored to a support member 61 disposed on the longitudinal support frame 60, and a plurality of heater elements 10a are juxtaposed substantially in a U-shape. A horizontal support frame 62 is connected to the longitudinal support frame 60. A shield 59 is fixed by screws 63 to the upper part of the back of the support frame 60. Two fitting plates 64 and 66 that extend upwardly are integrally formed with this shield plate 59. Three support members 61 in a vertical direction, and the support members 61 in the upper stage and the support member of the longitudinal support frame 60 are connected to each other by a fuse 65. The support member 61 of the intermediate stage and the support member 61 of the lower stage are connected to each other through a temperature detector 70 (FIGS. 9 and 11).

Figure 10:
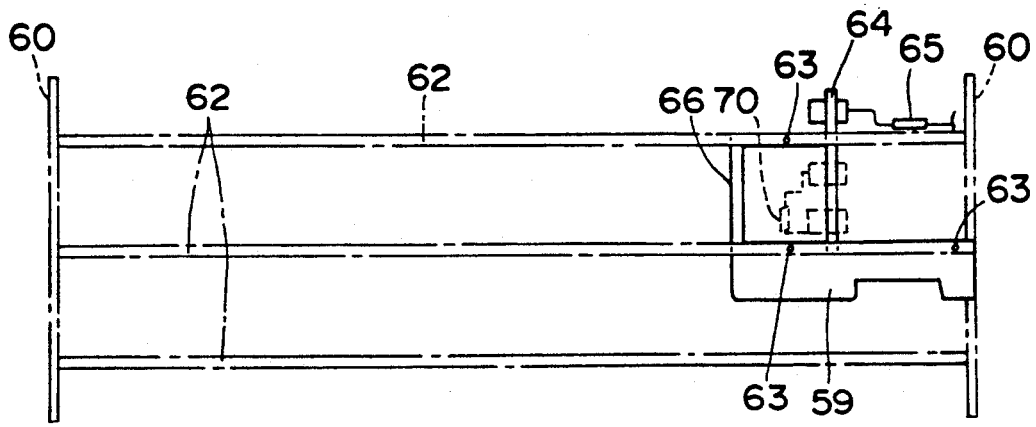
FIG. 10 is an explanatory diagram showing the relation between the support frame and the shield plate shown in FIG. 8.

FIG. 10 is a front view of the longitudinal parallel and transverse support frames 60 and 62 and shows the state where the heater element 10a is removed. The shield plate 59 and two fitting plates 64 and 66 are integrally formed, and the back of the transverse support frame 62 is fixed to a ring by the screw 63.

Operation of the support frames will be explained. The motor 5 and the compressor 26 of the packaged terminal air conditioner 24 are first driven by predetermined means so as to cause refrigerant to flow through the compressor, the cool/heat flow path switch valve (not shown), the indoor heat exchanger 11, an expansion valve (not shown) and the outdoor heat exchanger 13, and the room is cooled or heated. Heating can be by supplying power to the electric heater 10.

The air flowing into the electric heater 10, shown by the arrows in FIG. 2, strikes the heater element 10*a* from the indoor heat exchanger 11, passes as hot air through the inside of the support frames 60 and 62, flows to the indoor blower 7 at the back and is discharged from the blower. The hot air thus discharged from the blower 7 is discharged into the room from the discharge path 72 at the upper portion of the indoor section 3 through the outlet 36.

In this case, the shield plate 59 is positioned at the back of the heater element 10*a* of the electric heater 10 as shown in FIG. 11, and hot air flowing into this portion impinges against the shield plate 59 and does not pass through it. Therefore, if this air is abnormally heated, the temperature detector 70 disposed at the upper portion immediately detects this abnormal heating and the fuse 65 starts its operation. Moreover, since the temperature detector 70 and the fuse 65 are fitted to the fitting plates 64 and 66 disposed integrally with the shield plate 59, the distance between the heater element 10*a* and the fuse 65 or the temperature detector 70 can be kept as designed, and from this point, the temperature detector 70 can make accurate detection.

As described above, the shield plate is disposed at a part of downstream side of the electric heater and the fuse and/or the temperature detector is directly fitted to the shield plate. Therefore, the distance between the heater and the fuse or the temperature detector can be kept as designed. Accordingly, heat radiation of the heater sent up by the shield plate can be guided reliably to the fuse and to the temperature detector, and abnormal heating of the heater can be reliably detected.

What is claimed is:

1. An air conditioner comprising:

a housing;

a bottom plate having a partition fitted into said housing and partitioning the inside of said housing into an indoor section and an outdoor section, an indoor heat exchanger and an indoor disposed in said indoor section, an outdoor heat exchanger disposed at a back center portion of said outdoor section, an outdoor blower disposed opposite to said outdoor heat exchanger, suction ports on the back of said outdoor section, an outdoor fan case for guiding outdoor air drawn into said suction ports by said outdoor blower to said outdoor heat exchanger, an intake port disposed on said partition for guiding outdoor air sucked from one of said suction ports on the back of said outdoor section into said indoor section, p1 an outdoor air introduction path defined in said housing as extended from one of said suction ports to said intake port of said partition, an outdoor air discharge path defined in said housing as extending from said outdoor air introduction path to said outdoor heat exchanger, and a damper means disposed in said intake port of said partition for stopping substantially all air flow from said one of said suction ports to said outdoor heat exchanger by cutting off said outdoor air introduction path from said outdoor air discharge path when said intake port of said partition is opened and for providing substantially all of said air flow direct communication from said one of said suction ports to said intake port.

2. An air conditioner according to claim 1, and further comprising:

a drain pan disposed at a lower portion of said indoor heat exchanger, said indoor blower having an indoor fan case so disposed as to oppose said indoor heat exchanger, and a bell mouth plate having a resilient plate thereon inserted between said indoor fan case and said drain pan, said bell mouth plate being connected with said indoor fan case.

3. An air conditioner according to claim 1, and further comprising:

an air supply path defined in said indoor section, an electric heater disposed in said air supply path of said indoor section, a heat shield plate disposed in said air supply path of said indoor section, said heat shield plate being disposed downstream of said electric heater, a fitting plate formed integrally with said heat shield plate and extending above said heat shield plate, and a temperature detector means fixed to said fitting plate for detecting abnormal heating of said electric heater.

4. An air conditioner according to claim 3, wherein said temperature detector means has a fuse.

5. An air conditioner according to claim 2, further comprising:

an air supply path defined in said indoor section, an electric heater disposed in said air supply path of said indoor section, a heat shield plate disposed in said air supply path of said indoor section, a fitting plate formed integrally with said heat shield plate and extending above said heat shield plate, and a temperature detector means fixed to said fitting plate for detecting abnormal heating of said electric heater.

6. An air conditioner according to claim 5, wherein said temperature detector means has a fuse.

* * * * *